United States Patent [19]

Hoffmann et al.

[11] Patent Number: 4,985,068

[45] Date of Patent: Jan. 15, 1991

[54] METHOD AND APPARATUS FOR SMELTING IRON OXIDE

[75] Inventors: Glenn E. Hoffmann, Pineville, N.C.; John C. Scarlett, Toledo, Ohio

[73] Assignee: Midrex International BV, Rotterdam, Zurich Branch, Zurich, Switzerland

[21] Appl. No.: 441,823

[22] Filed: Nov. 27, 1989

[51] Int. Cl.[5] ..... C22B 4/00

[52] U.S. Cl. ..... 75/501; 75/502; 266/157; 266/155; 266/161

[58] Field of Search ..... 75/10.44, 51.5

[56] References Cited

U.S. PATENT DOCUMENTS 3,033,673 5/1962 Collin ..... 75/10.44

3,150,958 9/1964 Collin ..... 75/10.44

*Primary Examiner*—Peter D. Rosenberg

*Attorney, Agent, or Firm*—Ralph H. Dougherty

[57] ABSTRACT

Energy for melting iron oxide or wustite is supplied by pre-heated natural gas which is combusted with oxygen in gaseous form and the oxygen contained in the pre-heated feed materials. Such combustion produces carbon monoxide and hydrogen gas, thus the combustion products are carbonizing to molten iron. The carbon monoxide and hydrogen evolved at the surface of the molten metal is post-combusted above the bath to form a mixture of carbon monoxide, carbon dioxide, hydrogen, steam and nitrogen. The heat generated by this post-combustion is sufficient to supply the energy for all chemical reaction requirements as well as to melt the wustite charge or smelt the preheated iron oxide charge.

37 Claims, 2 Drawing Sheets

METHOD AND APPARATUS FOR SMELTING IRON OXIDE

BACKGROUND OF THE INVENTION

1. Field of the Invention

The present invention relates to a method and apparatus for smelting iron oxide or more particularly for melting prereduced iron oxide generally in the form of wustite, in a natural gas/oxygen bottom blown melting vessel which incorporates a hot air blast above the bath for post combustion of off gases.

2. Description of the Prior Art

In the presently operated smelting reduction processes, coal is utilized as the fuel. Coal is injected into the bath or blown onto the top of the bath but is not combusted with oxygen. Coal, or other fuel, is always introduced into the smelter as a separate process stream and not with any other reactant or component.

In addition, in presently operated processes, iron oxide is introduced to smelting reduction furnaces in the agglomerated forms of pellets or briquets to minimize creation and emission of dust from the smelter, which dust adheres to the interior walls of smelter off-gas ducts or conduits, clogging these gas passageways.

The applicants are aware of the following patents concerning iron oxide smelting and related matters, which vary in relevance to the present invention. The patent number refers to a U.S. Patent Number unless indicated otherwise.

| Pat. No. | Issue Date | Inventor | Title |
|---|---|---|---|
| 4,195,985 | Apr. 1, 1980 | BROTZMANN | METHOD OF IMPROVEMENT OF THE HEAT-BALANCE IN THE REFINING OF STEEL |
| EURO 017 963 | Oct. 29, 1980 | HIRAL, et al | CONVERTER STEELMAKING PROCESS |
| 3,960,546 | Jun. 1, 1976 | ROTE et al | METHOD FOR ELIMINATING NOSE-SKULLS FROM STEELMAKING VESSELS |
| 4,029,497 | Jun. 14, 1977 | NIXON | MANUFACTURE OF ALLOY STEELS AND FERROUS ALLOYS |
| 4,543,123 | Sep. 24, 1985 | VULETIC | PROCESS FOR THE DIRECT PRODUCTION OF SPONGE IRON PARTICLES AND LIQUID CRUDE IRON FROM IRON ORE IN LUMP FORM |
| 2,757,921 | Aug. 7, 1956 | PETERSON | METHOD FOR BURNING OF MATERIALS WITH HEAT RECOVERY |
| 3,776,533 | Dec. 4, 1973 | VLNATY | APPARATUS FOR CONTINUOUS HEAT PROCESSING OF ORE PELLETS |
| 4,712,774 | Dec. 15, 1987 | LOUIS | DEVICE FOR THE MELTING OF LIGHT METALS |
| 4,715,584 | Dec. 29, 1987 | HENGELMOLEN | FURNACE FOR MELTING METALS |
| 4,212,452 | Jul. 15, 1930 | HSIEH | APPARATUS FOR THE DIRECT REDUCTION OF IRON ORE |
| 4,397,684 | Aug. 9, 1983 | GROSJEAN | PROCESS FOR PNEUMATIC STIRRING OF A BATH OF MOLTEN METAL |
| 4,356,035 | Oct. 26, 1982 | BROTZMANN et al | STEELMAKING PROCESS |
| 4,272,287 | Jun. 9, 1981 | YAJIMA et al | PROCESS FOR REFINING MOLTEN STEEL CONTAINING CHROMIUM |
| 4,409,024 | Oct. 11, 1983 | KATO | TOP-AND-BOTTOM BLOWN CONVERTER STEELMAKING PROCESS |
| 3,854,932 | Dec. 17, 1974 | BISHOP, JR. | PROCESS FOR PRODUCTION OF STAINLESS STEEL |
| 4,302,244 | Nov. 24, 1981 | SIECKMAN et al | STEEL CONVERSION METHOD |
| 4,592,778 | Jun. 3, 1986 | FUJII et al | STEELMAKING OF AN EXTREMELY LOW CARBON STEEL IN A CONVERTER |
| 4,280,838 | Jul. 28, 1981 | MARUKAWA et al | PRODUCTION OF CARBON STEEL AND LOW-ALLOY STEEL WITH BOTTOM BLOWING BASIC OXYGEN FURNACE |
| 4,290,802 | Sep. 22, 1981 | HIRATA et al | STEEL MAKING PROCESS |
| 4,334,921 | Jun. 15, 1982 | HIRAI et al | CONVERTER STEELMAKING PROCESS |
| 4,358,314 | Nov. 9, 1982 | NORMANTON | METAL REFINING PROCESS |

-continued

| Pat. No. | Issue Date | Inventor | Title |
|---|---|---|---|
| 4,402,739 | Sep. 6, 1983 | NAKANISHI et al | METHOD OF OPERATION OF A TOP-AND-BOTTOM BLOWN CONVERTER |
| 4,651,976 | Mar. 24, 1987 | ARIMA et al | METHOD FOR OPERATING A CONVERTER USED FOR STEEL REFINING |
| UK 2059997A | Apr. 29, 1981 | BOGDANDY et al | METHOD OF MAKING STEEL FROM SOLID FERROUS METAL CHARGES |
| EURO 111 176 | Nov. 11, 1983 | KORF et al | METHOD AND INSTALLATION FOR DIRECT PRODUCTION OF SPONGE IRON PARTICLES |
| 4,008,074 | Feb. 15, 1977 | ROSSNER et al | METHOD FOR MELTING SPONGE IRON |

Brotzmann U.S. Pat. No. 4,195,985 teaches both top and bottom blowing, with an improved heat balance. This reference discloses after-burning of the carbon monoxide, and also discloses the use of natural gas, but not as the sole fuel.

European Patent Application No. 17,963 of Nippon Steel teaches a top and bottom blown smelting operation, and sets forth a thorough description of the prior art.

The Rote patent teaches the use of combustible fuel such as natural gas, propane, fuel oil or the like (see column 3, lines 5 to 7). Rote's top and bottom blown vessel is concerned with reducing nose skull in the top of the vessel, and utilizes commercially pure oxygen.

Nixon teaches that wustite can be treated by blowing it with a feed gas which is reducing to wustite in a converter.

Vuletic shows removal of large particulates, so they will not reach the fluidized bed. Rossner shows a similar process, but omits the natural gas and the top air elements.

With the exception of Rote, the patents cited above do not appear to show any teaching of one-hundred percent (100%) of the fuel being natural gas, nor do any of them specifically show air rather than substantially pure oxygen as the combustion gas above the bath.

Applicants are unaware of any prior art that accomplishes the objects of the present invention. Consequently, a need exists for a method and apparatus which will result in improved smelting of iron oxide, particularly from the form of wustite.

SUMMARY OF THE INVENTION

The present invention is an innovative method and apparatus for smelting iron oxide, which overcomes the problems and satisfies the needs previously considered.

Energy for melting the feed materials is supplied by pre-heated natural gas which is combusted with oxygen in gaseous form and the oxygen contained in the preheated iron oxide or wustite. Such combustion produces carbon monoxide and hydrogen gas, thus the combustion products are carburizing to molten iron. The carbon monoxide and hydrogen evolved at the surface of the molten metal is post-combusted with preheated air above the bath to form a mixture of carbon monoxide, carbon dioxide, hydrogen, steam and nitrogen. The post combustion air need not be enriched. The heat generated by this post-combustion is sufficient to supply the energy for all chemical reaction requirements as well as to melt the wustite charge or smelt the preheated iron oxide charge. In particular, the post combustion heat melts iron-bearing fine materials, returning them to the bath, thus avoiding clogging of off-gas conduits with entrained fines.

In summary, the invention encompasses a method and apparatus for melting pre-reduced iron oxide charged into a molten iron bath, utilizing natural gas as a fuel, and resulting in an iron product containing a desireable level of carbon.

OBJECTS OF THE INVENTION

The principal object of the present invention is to provide an economical process for melting pre-reduced iron oxide, particularly wustite, utilizing natural gas as a fuel.

It is also an object of the present invention to provide an economical process for smelting-reduction resulting in an iron product containing 0.1 to 5 percent carbon.

Another object of the invention is to provide an iron smelting process, including oxidization of carbon dioxide and hydrogen gases evolving from the surface of a smelter bath by a hot air blast introduced to the smelter above the surface of the bath, so that post combustion of 25 to 66 percent of the evolved gases occurs.

Another object of the invention is to provide a smelting process which will generate sufficient post-combustion heat to supply the energy for all chemical reaction requirements as well as to melt the wustite charge or smelt the preheated iron oxide charge.

A further object of the invention is to provide means for recovering sensible heat from the process for steam generation.

It is another object of the invention to provide apparatus for prereducing and smelting iron oxide without requiring a gas reformer.

BRIEF DESCRIPTION OF THE DRAWINGS

The foregoing and other objects will become more readily apparent by referring to the following detailed description and the appended drawings in which.

DETAILED DESCRIPTION

Figure 1:
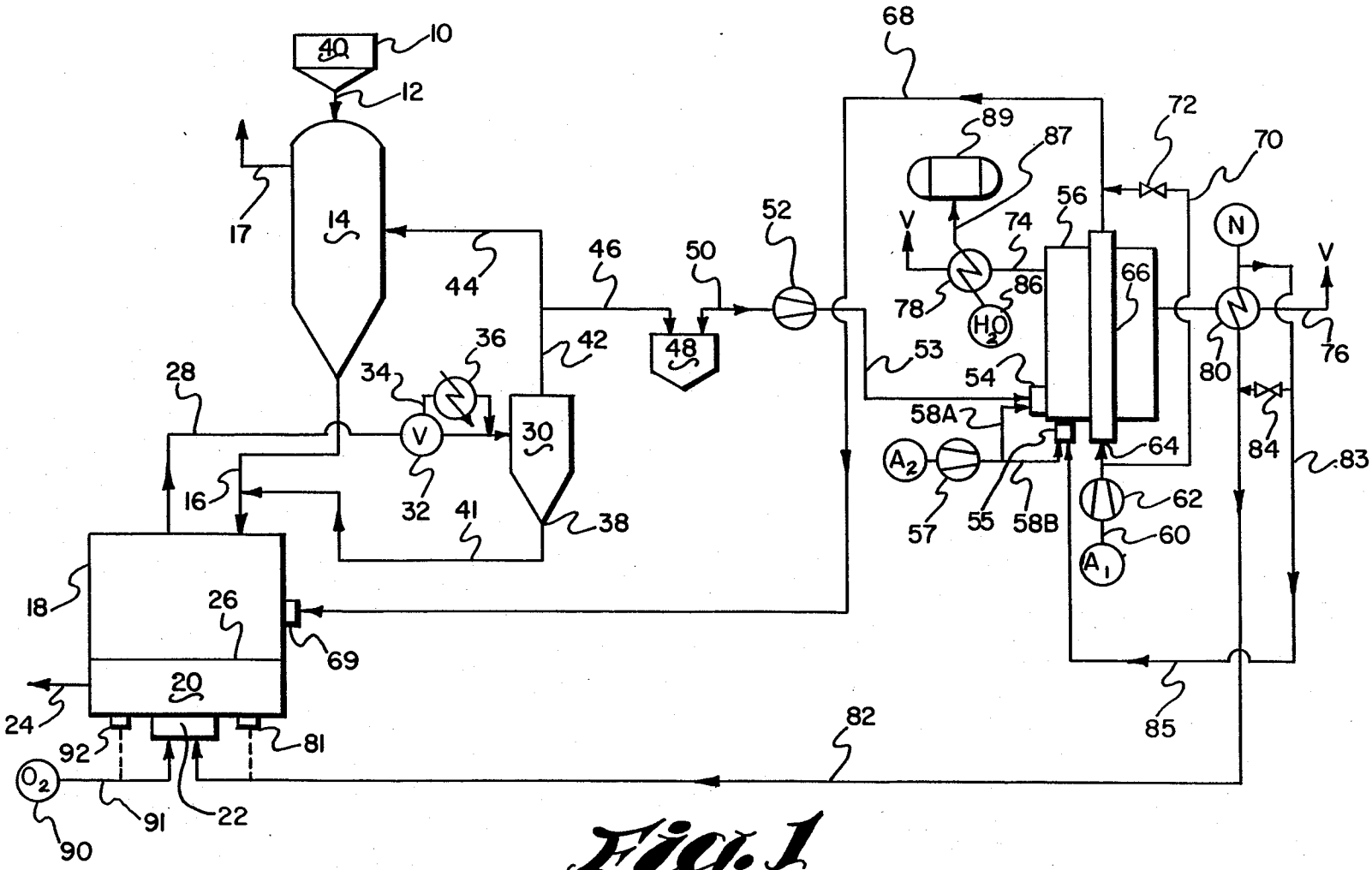
FIG. 1 is a schematic flow diagram showing the invented process for smelting reduction of iron oxide or wustite with natural gas, utilizing a single heat concept.

Referring now to the drawings, FIG. 1 shows a schematic diagram for smelting reduction of wustite by a single heat (once through) process which comprises the preferred embodiment of the present invention.

A bin 10 for holding iron oxide 40, or some form thereof, such as wustite, is connected by feed line or pipe 12 to a shaft furnace 14, the bottom or discharge end of which furnace 14 is connected by feed line or pipe 16 to a smelter 18. A spent gas offtake 17 communicates with the top of the furnace. Smelter 18 contains a molten metal bath 20 therein, and has a hot fuel gas injection device or tuyere 22 in the bottom wall of the smelter. A tapping outlet 24 is provided in the smelter sidewall beneath the bath line 26, or in the bottom wall. A reacted gas off-take pipe 28 communicates with the top of the smelter 18 and a hot cyclone 30. The off-take pipe is preferably provided with a valve 32 therein, as well as a bypass line 34 having a gas cooler 36 therein. The hot cyclone 30 has a bottom solids outlet 38 with a solids feed line 41 which returns the solids underflow to the smelter 18. The top of the cyclone 30 has a hot gas removal line 42, which divides the hot gases, returning a portion of the gases to the shaft furnace 14 through line 44. The remaining gases pass through a pipe 46 to a cooler scrubber 48.

Cooled, cleaned gas exit conduit 50 connects cooler scrubber 48 to compressor 52, which in turn is connected by line 53 to off-gas burner 54 of air preheater 56. A source of air A2 is connected to compressor 57, which is connected through lines 58A and 58B to burner 54 and natural gas burner 55. A source of air A1 is connected by line 60 to a compressor 62, then through a feed line 64 which communicates with the air intake of the preheater 56. The air preheater 56 is provided with at least one air heating tube 66, but usually a multiplicity of air heating tubes lie mostly within the preheater chamber, which is heated by burners 54 and /or 55. A heated air discharge line 68 communicates with hot air injection tuyere 69 in smelter 18, which is located preferably in the smelter sidewall, or alternatively in the smelter top wall, but which is always above the bath line. A tempering bypass line 70 is connected to the air injection line 64 and to the hot air removal line 68 bypassing the preheater, and control valve 72 is situated within the bypass line 70.

Vent conduits 74 and 76 communicate with the air preheater chamber 56 for removing products of combustion, and communicate with heat exchangers 78 and 80 respectively. A source N of natural gas is connected to heat exchanger 80, which is in turn connected to tuyere 22 or gas injector 81 of the smelter 18 by a hot gas conduit 82. A cold natural gas conduit 83 bypasses the heat exchanger 80, and is connected to the natural gas conduit 82 on each side of the heat exchanger 80, a control valve 84 being provided in the bypass line. Natural gas line 85 is connected to natural gas burner 55 to provide a source of fuel.

Heat exchanger 78 is a boiler which heats water from source 86. The boiler is connected by conduit 87 to a steam tank 89. Oxygen source 90 is connected by conduit 91 to tuyere 22, and/or alternatively to oxygen injector 92.

Figure 2:
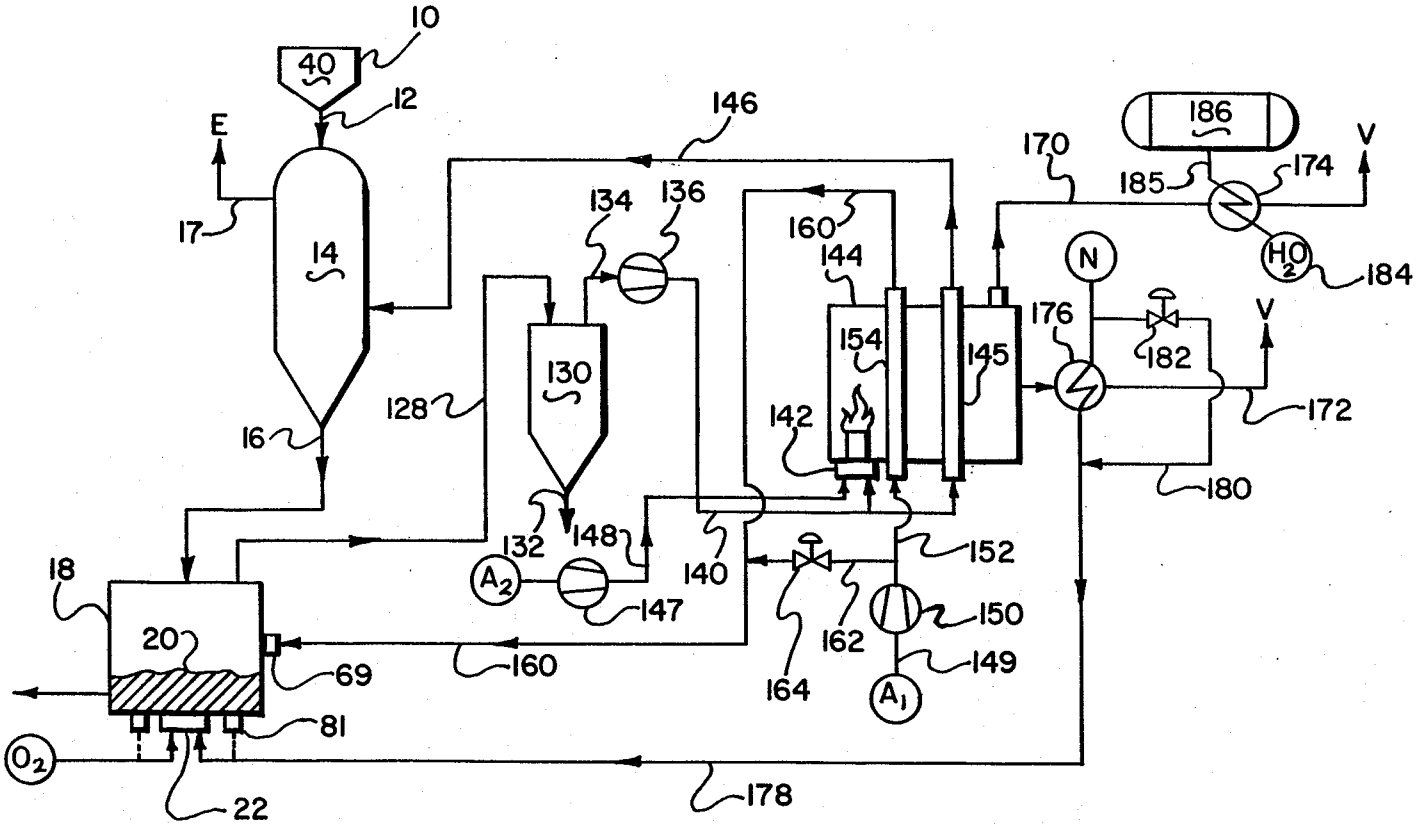
FIG. 2 is a schematic flow diagram similar to FIG. 1, showing an alternative embodiment to the invented process for smelting reduction of iron oxide or wustite with natural gas, and utilizing a double heat concept.

FIG. 2 shows an alternative embodiment to the invented process for smelting reduction of iron oxide or wustite with natural gas, utilizing a double heat concept.

In this embodiment, bin 10 for holding iron oxide 40 or wustite is connected by feed pipe 12 to a shaft furnace 14 having a spent gas offtake 17 at the top of the furnace, and the bottom of the furnace 14 being connected by feed pipe 16 to smelter 18, which contains a molten metal bath 20 therein. A reacted gas off-take pipe 128 communicates with the top of the smelter 18 and a cooler-scrubber 130. The cooler-scrubber has a bottom waste solids outlet 132 for removing the solids underflow.

Cooled, cleaned gas exit conduit 134 connects cooler-scrubber 130 to compressor 136, which in turn is connected by conduit 140 to burner 142 of preheater 144 and to gas heating tube or tubes 145 in preheater 144. The exit end of gas heating tube 145 is connected by hot gas conduit 146 to the hot gas intake of shaft furnace 14. A source of combustion air A2 is connected to compressor 147, which is connected through line 148 to burner 142. A source of process air Al is connected by line 149 to a compressor 150, then through a feed line 152 which communicates with the air intake of air heating tube 154 of the preheater 144. A heated air discharge line 160 communicates with hot air injection tuyere 69 in smelter 18, which is located in the smelter sidewall or top wall above the bath line. A tempering bypass line 162 is connected to the air injection line 152 and to the hot air removal line 160 bypassing the preheater 144, and has control valve 164 situated within the bypass line 162.

Vent conduits 170 and 172 communicate with the air preheater chamber 144 for removing products of combustion, and communicate with heat exchangers 174 and 176 respectively. A source N of natural gas is connected to heat exchanger 176, which is in turn connected to tuyere 22 or gas injector 81 of the smelter 18 by a hot gas conduit 178. A cold natural gas conduit 180 bypasses the heat exchanger 176, and is connected to the natural gas conduit 178 on each side of the heat exchanger 176, a control valve 182 being provided in the bypass line.

Heat exchanger 174 is a boiler which heats water from source 184. The boiler is connected by conduit 185 to a steam tank 186.

OPERATION

In the operation of the embodiment shown in FIG. 1, iron oxide from bin 10 is fed into shaft furnace 14, wherein it is heated and usually pre-reduced. Pre-reduction depends upon the quality of the gas introduced through line 44, which gas contains both oxidants ($CO_2$ and $H_2O$) and reductants (CO and $H_2$). The ratio of reductants to oxidants in the gas is the measure of "gas quality". If the gas quality introduced through line 44 is from 0.6 to 2.0, the output of the shaft furnace is wustite. If the hot gas introduced through line 44 has a quality in excess of 2.0, the output of the shaft furnace is metallized iron. If the gas quality is less than 0.6, it merely heats the burden in the shaft furnace. The heated iron oxide or pre-reduced iron oxide is removed from the shaft furnace 14 through conduit 16, then charged into smelter 18. Natural gas and oxygen are introduced into the smelter through tuyere 22 or individually through tuyeres 81 and 92 respectively. It is preferable to utilize a dual concentric tuyere wherein oxygen is introduced through the central conduit and natural gas through an outer annular conduit. As many such tuyeres 22 as are necessary to operate the smelter are provided in the bottom wall of the smelter. The natural gas is combusted with the oxygen to provide the heat necessary to melt the charge to the smelter.

Smelter 18 is fed with iron oxide or wustite. Oxygen and preheated natural gas are introduced to the smelter beneath the bath 20. The natural gas is combusted with oxygen in such manner that the combustion products are not oxidizing to the molten iron in the smelter which contains some dissolved carbon. Thus, the gases carburize the melt to carbon contents in the range of 0.1 to 5.0 percent. Note that combustion occurs below the surface of the melt. In addition, carbon dioxide and hydrogen gases evolve from the bath at the surface and are oxidized by a hot air blast introduced to the smelter through gas injector 69 above the surface of the bath, which provides post combustion of 25 to 66 percent of the evolved gases. The hot air is preheated and injected as an air blast at from about 815° to about 1100° C., but generally the air blast is at a temperature of from 950° to 1050° C., and preferably is about 1000° C. Forty-five percent post combustion produces a flue gas, or off-gas, from the smelter having a quality of about 1.2 and a temperature in the range of 1550° to 1790° C. Such flue gas has a higher heating value (HHV) of approximately 900 kilocalories per normal cubic meter (Kcal/$Nm^3$). A portion of the flue gas from the melter is cooled by cooler 36 in bypass 34 to bring the temperature of the gas in the conduit following the bypass down to at least 927° C. This gas is then cleaned of dust, by hot cyclone 30, then utilized as bustle gas in prereduction shaft furnace 14.

The charge materials fed to the melter are wustite or iron oxide, either cold, i.e., at ambient temperature or up to about 25 degrees C., or preheated to about 927° C. in the single heat embodiment, or up to about 1150° C. in the double heat process embodiment.

Energy for melting the feed materials in the smelter is supplied by pre-heated natural gas which is combusted with oxygen in gaseous form and the oxygen contained in the preheated iron oxide or wustite. Such combustion produces carbon monoxide and hydrogen gas, thus the combustion products are carburizing to molten iron. The carbon monoxide and hydrogen evolved at the surface of the molten metal is post-combusted above the bath to form a mixture of carbon monoxide, carbon dioxide, hydrogen, steam and nitrogen. The heat generated by this post-combustion is sufficient to supply the energy for all chemical reaction requirements as well as to melt the wustite charge or smelt the preheated iron oxide charge.

Pre-reduction of the iron oxide charge, when in the form of hematite is accomplished in a shaft furnace. Bustle gas to the shaft furnace comprises a portion of the cooled flue gas from the melter after passing through a hot cyclone. Top gas from the shaft furnace, which is normally considered to be a waste product, is removed through line 17.

The balance of the melter flue gas not used for prereduction is quenched and scrubbed in cooler-scrubber 48, compressed and thereafter used as a fuel in burner 54, combustion air being provided from source A1, for firing process air preheater 56, off-gas from which heats process natural gas in heat exchanger 80. A waste heat boiler 78 can be incorporated in the heater flue gas stream 74 in order to recover the sensible heat for steam generation. The high pressure/high temperature steam from tank 89 can then be used to generate electricity, or as process steam to drive compressors used in an associated oxygen plant.

Products of combustion removed from the air preheater 66 through heat exchanger 80 preheat natural gas, generally to about 400° to 550° C. Cold natural gas is introduced from tempering line 83 and mixed with hot natural gas in conduit 82 to maintain the natural gas temperature delivered to tuyere 22 at about 500° C.

In the operation of the double heat embodiment shown in FIG. 2, reacted flue gas removed from the top of the smelter 18 is cooled and cleaned in cooler-scrubber 130, from which the waste solids underflow are removed at outlet 132.

Cooled, cleaned gas is compressed and divided, a portion being delivered to burner 142 of preheater 144 as fuel, and a second portion to gas heating tubes 145 in preheater 144. After preheating the second portion of gas, it is introduced to the hot gas intake of shaft furnace 14. Combustion air for the burner 142 is provided by combustion air source A2. A source A1 of process air feeds air through compressor 150, then through air heating tubes 154 of the preheater 144, wherein the air is preheated to about 1000° C. The heated air is conducted to hot air blast injection tuyere 69 in the smelter sidewall or top wall above the bath line.

SUMMARY OF THE ACHIEVEMENTS OF THE OBJECTS OF THE INVENTION

From the foregoing, it is readily apparent that we have invented a device for providing an economical process for melting pre-reduced iron oxide charged into a molten iron bath, utilizing natural gas as a fuel, and resulting in an iron product containing from about 0.1 to about 5 percent carbon.

It is to be understood that the foregoing description and specific embodiments are merely illustrative of the best mode of the invention and the principles thereof, and that various modifications and additions may be made to the device by those skilled in the art, without departing from the spirit and scope of this invention, which is therefore understood to be limited only by the scope of the appended claims.

We claim:

1. A method for smelting reduction of iron oxide, comprising:

(a) feeding prereduced iron oxide into an enclosed smelter;

(b) heating, melting and reducing said iron oxide to molten metal by combusting an excess of natural gas with oxygen, carburizing the molten metal by dissolving dissociated carbon in the metal, and forming a reacted off-gas;

(c) introducing hot air into the enclosed smelter above the molten bath and oxidizing a portion of the off-gas to produce a flue gas;

(d) cleaning and cooling said flue gas to a temperature of from about 800° to 950° C.;

(e) contacting said iron oxide with said cleaned flue gas to perform the prereducing function; and (f) drawing off molten iron product.

2. A method according to claim 1 wherein said reduced iron oxide is wustite.

3. A method according to claim 2 wherein said wustite is preheated to a temperature in excess of 800° C. prior to feeding said wustite into the smelter.

4. A method according to claim 1 wherein a sufficient excess of natural gas is introduced to the smelter to raise the carbon content of the molten iron to from 0.1 to 5.0 percent.

5. A method according to claim 1 wherein hot air is introduced at a temperature of from 815° to 1100° C.

6. A method according to claim 5 wherein hot air is introduced at a temperature of from 950° to 1050° C.

7. A method according to claim 1 wherein heating, melting, reducing, and carburizing is accomplished by introducing natural gas and oxygen beneath the surface of the bath.

8. A method according to claim 7 wherein natural gas is preheated prior to its introduction.

9. A method for smelting reduction of iron oxide, comprising:

(a) feeding preheated iron oxide into an enclosed smelter;

(b) heating, melting and reducing said iron oxide to molten metal by combusting an excess of preheated natural gas with oxygen, carburizing the molten metal by dissolving dissociated carbon in the metal, and forming a reacted off-gas;

(c) introducing hot air into the enclosed smelter above the molten bath and oxidizing a portion of the off-gas to produce a flue gas;

(d) cleaning and cooling said flue gas to a temperature of from about 800° to 927° C.;

(e) contacting said iron oxide with said cleaned flue gas to perform the preheating function; and (f) drawing off molten iron product from the smelter.

10. A method according to claim 9 wherein said smelter flue gas has a reductant to oxidant ratio of from 0.6 to 2.0.

11. A method according to claim 9 wherein said preheated iron oxide is reduced to wustite prior to smelting.

12. A method according to claim 11 wherein said wustite is preheated to a temperature in excess of 800° C. prior to feeding said wustite into the smelter.

13. A method according to claim 9 wherein a sufficient excess of natural gas is introduced to the smelter to raise the carbon content of the molten iron to from 0.1 to 5.0 percent.

14. A method according to claim 9 wherein said hot air is preheated to about 815° to 1100° C. prior to introduction.

15. A method according to claim 13 wherein said natural gas is preheated to about 815° to 1100° C. prior to introduction.

16. A method of smelting iron oxide, comprising the steps of:

(a) feeding iron oxide into a smelter, and creating a bath of molten iron therein;

(b) introducing natural gas and oxygen into the smelter beneath the surface of the bath;

(c) combusting the natural gas with the oxygen in such manner that combustion products are not oxidizing to the molten iron;

(d) carburizing the molten iron to a carbon content in the range of 0.1 to 5 percent; and (e) post combusting carbon dioxide and hydrogen gases evolving from the surface of the bath with air.

17. A method according to claim 16 wherein said post combusting is accomplished by introducing heated air into the smelter above the bath.

18. A method according to claim 17 wherein said post combusting is accomplished by introducing sufficient heated air into the smelter above the bath so that post combustion of 25 to 66 percent of the evolved gases occurs.

19. A method according to claim 16 wherein the iron oxide is fed to the smelter at ambient temperature.

20. A method according to claim 16 further comprising preheating the iron oxide to a temperature up to 927° C. prior to feeding the iron oxide to the smelter.

21. Apparatus for smelting iron oxide, comprising:

(a) an enclosed smelter;

(b) means for feeding iron oxide into said smelter and creating a bath of molten iron;

(c) means for introducing natural gas and oxygen into said smelter beneath the bath;

(d) means for combusting the natural gas with the oxygen so that combustion products are not oxidizing to the molten iron in the smelter;

(e) means for carburizing the molten iron to carbon contents in the range of 0.1 to 5 percent; and (f) air introducing means in the smelter wall above the surface of the bath for oxidizing carbon dioxide and hydrogen gases evolving from the surface of the bath, whereby post combustion of from about 25 to about 66 percent of the evolved gases occurs.

22. The apparatus set forth in claim 21, wherein the feeding means includes a bin for holding iron oxide, and a shaft furnace connected between the bin and the smelter, for transferring iron oxide from the bin into the smelter.

23. The apparatus set forth in claim 22 further comprising means for preheating the iron oxide to a temperature up to 927° C.

24. The apparatus set forth in claim 23, wherein the preheating means includes:

means for collecting and removing hot flue gas from the smelter;

means for cleaning dust from the hot flue gas; and means for introducing at least a portion of the hot flue gas to the shaft furnace as bustle gas.

25. The apparatus set forth in claim 24, wherein said means for cleaning dust from the hot flue gas is a hot cyclone.

26. The apparatus set forth in claim 25, further comprising means for cooling a portion of the flue gas to at least 927° C. prior to delivery of the flue gas to the hot cyclone.

27. The apparatus set forth in claim 25, further comprising means for dividing the dust-free hot flue gas, means for quenching, scrubbing, and compressing a portion of the flue gas from said hot cyclone and means for introducing the scrubbed flue gas to a heater as fuel.

28. The apparatus set forth in claim 21, further comprising air preheating means communicating with said air introduction means for preheating air.

29. The apparatus set forth in claim 28, further comprising means for recovering sensible heat from the air preheater exhaust for steam generation.

30. The apparatus set forth in claim 29, wherein said sensible heat recovery means is a waste heat boiler.

31. The apparatus set forth in claim 23, wherein the preheating means includes:

means for collecting and removing hot flue gas from the smelter;

means for cooling and scrubbing said the hot flue gas;

means for reheating said cooled flue gas to at least 900° C.; and means for introducing at least a portion of the hot flue gas to the shaft furnace as bustle gas.

32. The apparatus set forth in claim 31, where said preheating means is a preheating furnace adapted to preheat both air and flue gas, the air preheating means communicating with said air introduction means in said smelter.

33. The apparatus set forth in claim 21, wherein the means for introducing oxygen and natural gas includes a source of oxygen and a source of natural gas, each source communicating with an underbath tuyere for introduction of oxygen and natural gas into the smelter beneath the bath.

34. The apparatus set forth in claim 33, wherein the tuyere is a dual concentric tuyere for introduction of oxygen and natural gas therethrough.

35. The apparatus set forth in claim 33, further comprising a natural gas heater communicating with said natural gas source and said tuyere for preheating the natural gas to at least 500° C.

36. The apparatus set forth in claim 35, further comprising means for tempering said natural gas to about 500° C.

37. The apparatus set forth in claim 33, including at least two tuyeres situated at the base of the smelter, and wherein the source of natural gas communicates with a natural gas injection tuyere, and the source of oxygen communicates with an oxygen injection tuyere.

* * * * *